US007652631B2

(12) United States Patent
McGrath

(10) Patent No.: US 7,652,631 B2
(45) Date of Patent: Jan. 26, 2010

(54) ULTRA-WIDEBAND ANTENNA ARRAY WITH ADDITIONAL LOW-FREQUENCY RESONANCE

(75) Inventor: Daniel McGrath, McKinney, TX (US)

(73) Assignee: Raytheon Company, Waltham, MA (US)

( * ) Notice: Subject to any disclaimer, the term of this patent is extended or adjusted under 35 U.S.C. 154(b) by 280 days.

(21) Appl. No.: 11/735,822

(22) Filed: Apr. 16, 2007

(65) Prior Publication Data

US 2008/0252539 A1 Oct. 16, 2008

(51) Int. Cl.
*H01Q 13/10* (2006.01)

(52) U.S. Cl. ..... 343/767; 343/770

(58) Field of Classification Search ..... 343/767, 343/770

See application file for complete search history.

(56) References Cited

U.S. PATENT DOCUMENTS

| | | | | |
|---|---|---|---|---|
| 5,081,466 | A * | 1/1992 | Bitter, Jr. | 343/767 |
| 5,428,364 | A | 6/1995 | Lee et al. | 343/767 |
| 5,519,408 | A * | 5/1996 | Schnetzer | 343/767 |
| 6,292,153 | B1 * | 9/2001 | Aiello et al. | 343/767 |
| 6,501,431 | B1 | 12/2002 | Irion, II et al. | 343/767 |
| 6,850,203 | B1 | 2/2005 | Schuneman et al. | 343/767 |
| 6,867,742 | B1 | 3/2005 | Irion, II et al. | 343/767 |
| 7,215,284 | B2 * | 5/2007 | Collinson | 343/700 MS |
| 7,403,169 | B2 * | 7/2008 | Svensson et al. | 343/767 |

FOREIGN PATENT DOCUMENTS

JP 11-23692 6/1997

OTHER PUBLICATIONS

Lee et al., "A Low-Profile Wide-Band (5:1) Dual-Pol Array", IEEE Antennas and Wireless Propagation Letters, vol. 2, pp. 46-49, 2003.
European Search Report; application No. 08006243.3-2220; date: Jul. 1, 2008; 10 pages.
Tyzh-Ghuang Ma et al., "A Novel Compact Ultra-wideband Printed Dipole Antenna with Tapered Slot Feed," IEEE Antennas and Propagation Society International Symposium, 2003 Digest, vol. 3, pp. 608-611, XP010747261, Jun. 22, 2003.
D.H. Schaubert et al., "TSA Element Design for 500-1500 MHz Array," IEEE, XP 10513875A, pp. 178-181, 2000.
Yo-shen Lin, et al., "Lumped-Element Impedance-Transforming Uniplanar Transitions and Their Antenna Applications," IEEE Transactions on Microwave Theory and Techniques, vol. 52, No. 4, pp. 1157-1165, Apr. 4, 2004.

* cited by examiner

*Primary Examiner*—Tan Ho
(74) *Attorney, Agent, or Firm*—Baker Botts L.L.P.

(57) ABSTRACT

In accordance with one embodiment of the present disclosure, methods and systems for radiating elements are provided. In a method embodiment, a method of forming a radiating element includes forming a pair of conductive fingers having first and second portions. The first portion is a dipole arm. The conductive fingers are separated by a tapered notch that has a width at a first end that is less than a width of a second end. For each conductive finger, the method also includes capacitively coupling the first portion of the conductive finger to the second portion of the conductive finger.

23 Claims, 5 Drawing Sheets

ULTRA-WIDEBAND ANTENNA ARRAY WITH ADDITIONAL LOW-FREQUENCY RESONANCE

TECHNICAL FIELD

This invention relates in general to antennas, and more particularly to methods and systems for radiating elements.

BACKGROUND

Antennas may be used in a variety of applications. Some applications have certain design constraints, such as, physical depth (protrusion and/or intrusion), operational bandwidth, low frequency operation, and/or receive and transmit functionality.

SUMMARY

According to the teachings of the present disclosure, enhanced radiating elements and methods of forming the same are provided. In a method embodiment, a method of forming a radiating element includes forming a pair of conductive fingers having first and second portions. The first portion is a dipole arm. The conductive fingers are separated by a tapered notch that has a width at a first end that is less than a width of a second end. For each conductive finger, the method also includes capacitively coupling the first portion of the conductive finger to the second portion of the conductive finger.

Some technical advantages of certain embodiments of the present disclosure include providing an efficient antenna that operates over an upper 5:1 bandwidth, with added spot coverage over a narrow band below approximately one tenth of the highest frequency. Other technical advantages of certain embodiments of the present disclosure include providing an antenna with an overall shallow depth that is approximately one seventh of a wavelength at the low frequency. Some embodiments may provide a shallow structure antenna capable of both transmitting and receiving over a 10:1 bandwidth.

Other technical advantages of the present disclosure will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION

According to the teachings of the present disclosure, enhanced radiating elements and methods of forming the same are provided. Some embodiments may provide a shallow structure antenna capable of both transmitting and receiving over a 10:1 bandwidth.

Figure 1:
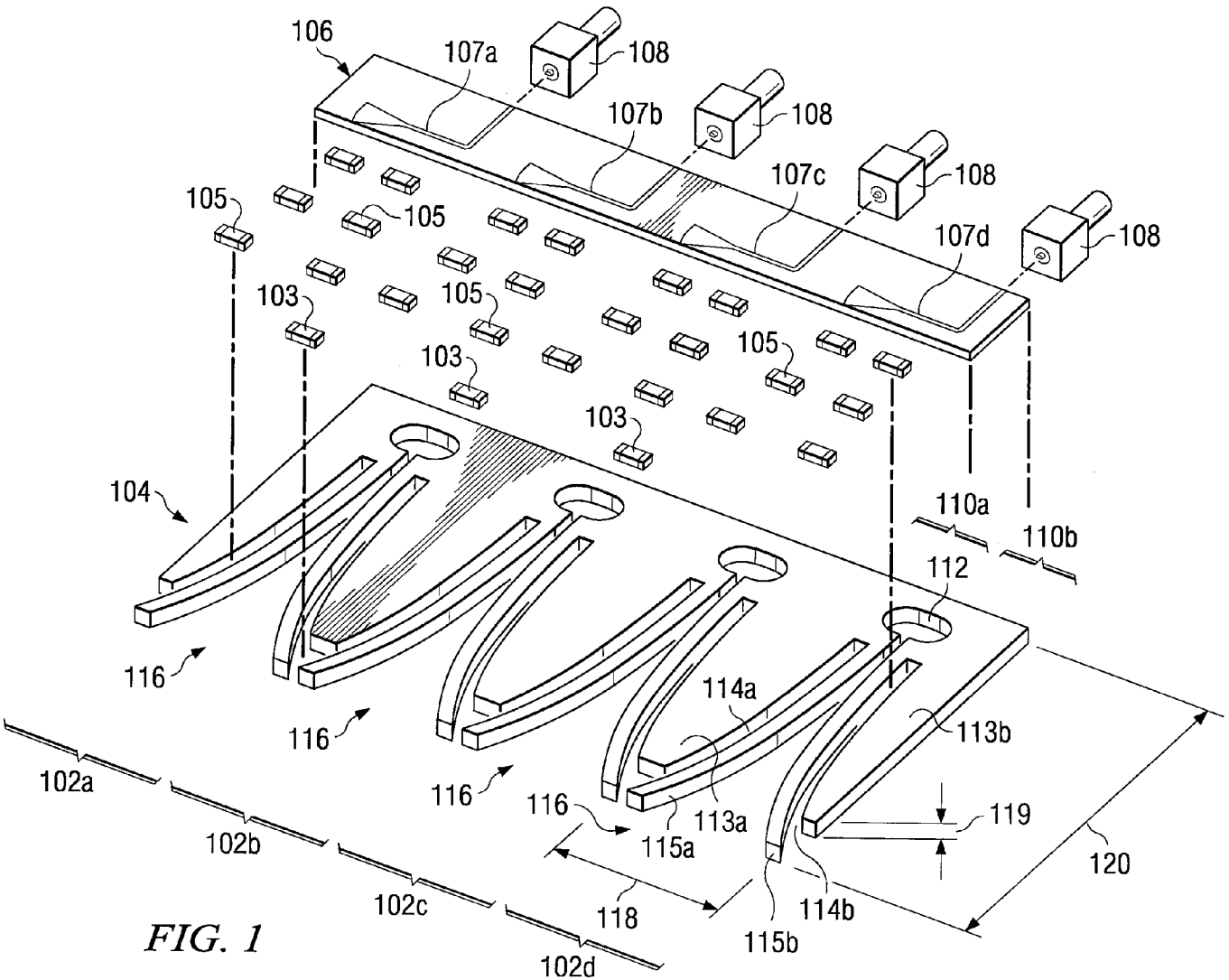
FIG. 1 is an exploded view of a portion of an antenna having plural radiating elements configured in an array according to one embodiment of the present disclosure.

FIG. 1 is an exploded view of a portion of an antenna 100 having plural radiating elements 102 configured in an array 104 according to one embodiment of the present disclosure. Each radiating element 102 is communicatively coupled through a dielectric layer 106 to respective connectors 108. In operation, antenna 100 is capable of efficiently transmitting and receiving signals over a wide bandwidth, as described further below.

In the example embodiment, each radiating element 102*a*, 102*b*, 102*c*, and 102*d* may both receive and transmit signals. The signal propagation path along each radiating element 102 partially depends on a frequency of the signal, as explained further below. In certain embodiments, this frequency-controlled dependency enables antenna 100 to efficiently operate over an upper 5:1 bandwidth, with added spot coverage over a narrow band at approximately one tenth of the highest frequency.

Each radiating element 102 generally includes a pair of conductive fingers (e.g., fingers 110*a* and 110*b* of radiating element 102*d*) at least partially separated by a balun 112 and a tapered notch 116. Baluns 112 generally facilitate impedance matching and tapered notches 116 generally enable operation of radiating elements 102 in a notch-antenna mode. Additionally, each finger 110 has a respective slot (e.g., slot 114*a* of finger 110*a* and slot 114*b* of finger 110*b*) that separates a respective half-spade-shaped portion 113 from a respective dipole arm portion 115. Although portions 113 are half-spade-shaped, any suitable shape may be used. In the example embodiment, slots 114 are formed approximately parallel to the profile of tapered notch 116. In this manner, radiating element 102 generally resembles a flared dipole inside a flared notch.

In the example embodiment, each radiating element 102 has a width 118, thickness 119 and length 120 tuned to particular frequency responses. These dimensions 118, 119, and 120 may be quantified in wavelengths with respect to a high frequency limit ($f_{max}$) of antenna 100. For example, as shown in FIG. 1, each radiating element has an approximate width 118 and length 120 of 0.58 and 2.0 wavelengths respectively relative to the $f_{max}$ wavelength; however, any suitable dimensions may be used depending on the desired frequency response of antenna 100. In addition, each radiating element 102 has a thickness 119 and a slot 114 width of approximately 0.04 and 0.03 wavelengths respectively; however, thickness 119 and slot 114 width may vary substantially.

The relative dimensions 118, 119 and 120 and spacing of antenna 100 are for example purposes only and not intended to limit the scope of the present disclosure. In various embodiments, the dimensions and spacing illustrated in FIG. 1 may enable a scan angle of ±45° at $f_{max}$; however, any suitable dimensions or spacing operable to support any of a variety of scan angles may be used. Although FIG. 1 illustrates four radiating elements 102*a*, 102*b*, 102*c*, and 102*d*, antenna 100 may include any suitable number of radiating elements. Radiating elements 102 are configured in an array 104 having a single row; however, radiating elements 102 may have any suitable configuration. For example, radiating elements 102 may be configured in multiple rows arranged vertically, thereby forming a two-dimensional array.

Figure 3:
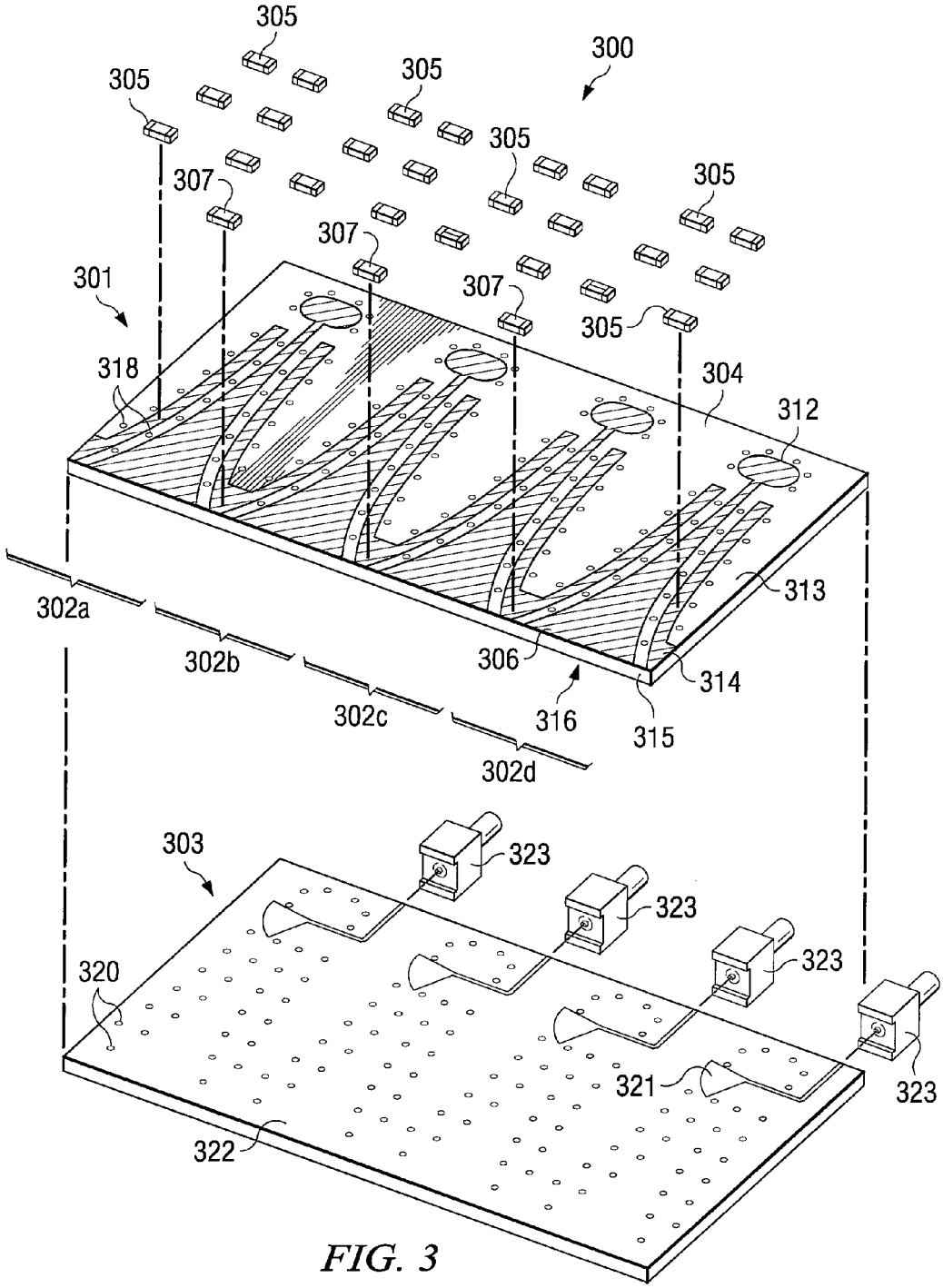
FIG. 3 is an exploded view of a portion of an antenna having plural stripline circuit cards according to one alternative embodiment of the present disclosure.
Figure 4:
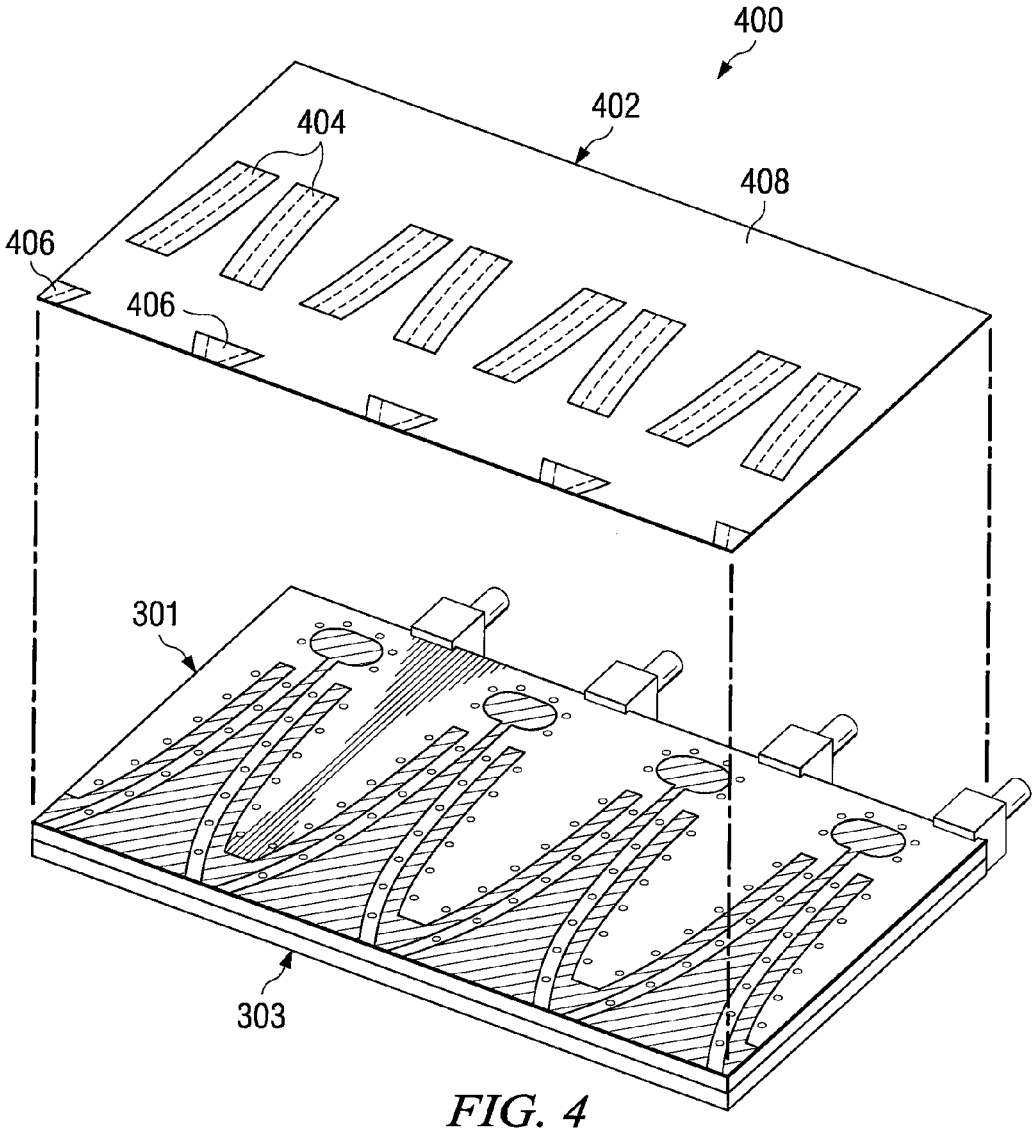
FIG. 4 is an exploded view of a portion of an antenna that capactively couples the plural stripline circuit cards of FIG. 3 to a cover sheet.
Figure 5:
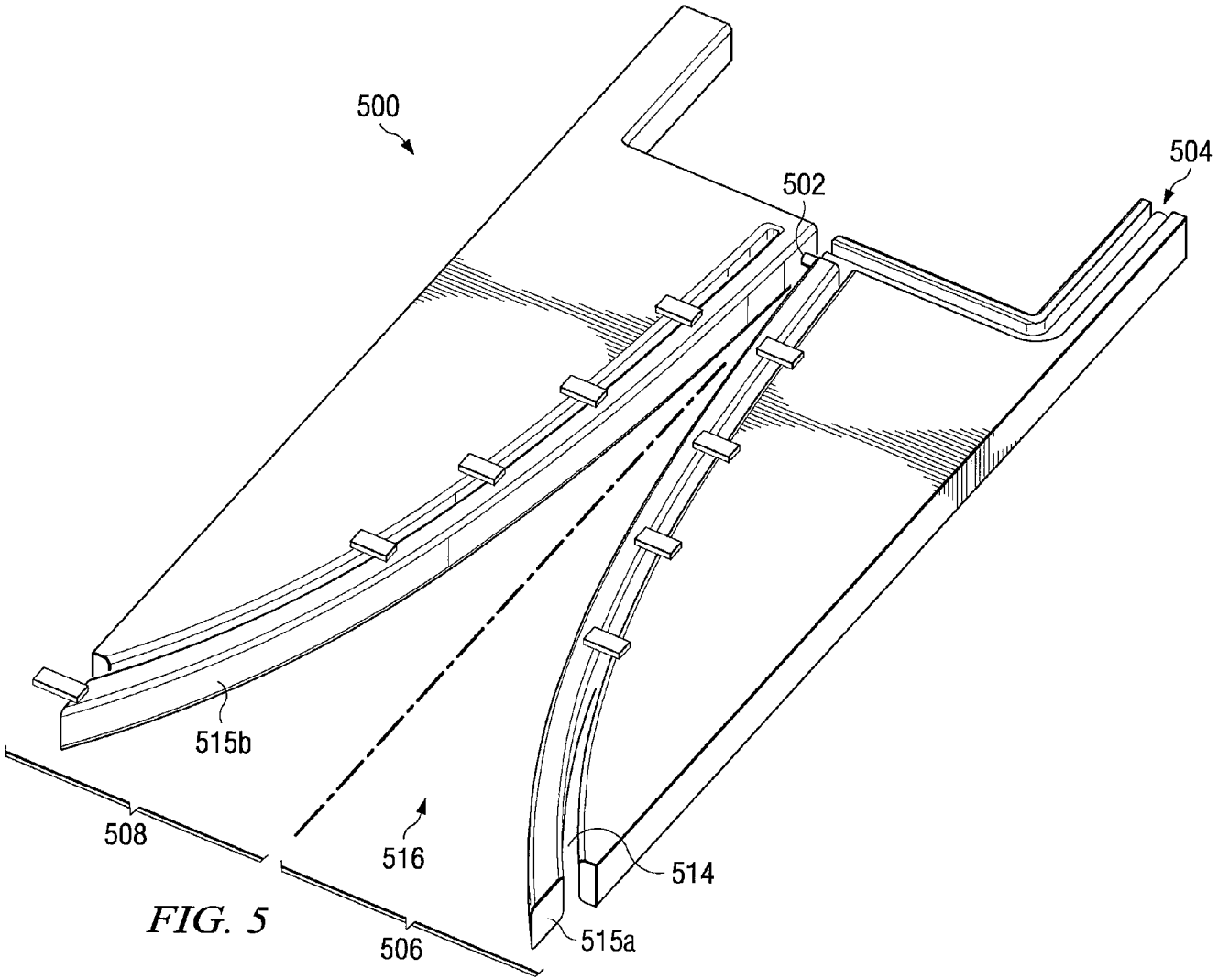
FIG. 5 illustrates a perspective view of a single radiating element having a coaxial feed according to one embodiment of the present disclosure.

Forming array 104 may be effected by any of a variety of processes using any suitable material(s) capable of communicating a signal. In the example embodiment, array 104 is formed by machining a solid, electrically conductive plate to form baluns 112, slots 114 and tapered notches 116 of each radiating element 102. Some alternative example methods of forming array 104 are illustrated in FIGS. 3 through 5 below.

A set of slot capacitors 105 generally enable antenna 100 to behave like a dipole antenna at one or more low frequencies and as a notch antenna at higher frequencies. In the example embodiment, slot capacitors 105 are discrete components surface mounted to array 104 in a manner that capacitively couples half-spade-shaped portions 113 to respectively adjacent dipole arms 115. Slot capacitors 105 have frequency dependent impedance. That is, slot capacitors 105 behave as open circuits at lower frequencies and as short circuits at higher frequencies, thereby modifying the frequency response of antenna 100. As shown in FIG. 1, slot capacitors 105 are positioned at plural locations along the length of respective slots 114, thereby efficiently distributing the capacitive coupling between portions 113 to respectively adjacent dipole arms 115. Some alternative embodiments may position slot capacitors 105 elsewhere, such as, for example, within respective slots 114.

Some alternative embodiments may not include slot capacitors 105. In some such embodiments, slots 114 may be sufficiently narrow in width to capacitively couple portions 113 directly to respective dipole arms 115 due to their relative proximity. In another example, varactor diodes may be used in place of slot capacitors 105, thereby enabling a voltage-controlled, frequency-tunable design. Some alternative embodiments may electrically couple portions 113 and respective dipole arms 115 using switches, such as, for example, field-effect transistors, diodes, and/or electromechanical systems. In still another alternative example, conductive material may be disposed on dielectric layer(s) 106 or on a second dielectric layer in a manner that overlaps and bridges portions 113 and dipole arms 115, as described further below with reference to FIG. 4.

In the example embodiment, a set of dipole capacitors 103 capacitively couple dipole arms 115 of adjacent radiating elements 102, thereby enabling antenna 100 to be tuned to a desired low frequency resonance. In one non-limiting example, dipole capacitors 103 and slot capacitors 105 may enable low frequency resonance for antenna 100 at 7.5% of a high frequency limit ($f_{max}$), as illustrated further below with reference to FIG. 2. The capacitive properties of dipole capacitors 103 and slot capacitors 105 may independently vary depending on the desired frequency response of antenna 100.

Dielectric layer 106 generally facilitates signal communication between radiating elements 102 and respective connectors 108. As shown in FIG. 1, dielectric layer 106 is a circuit card formed from epoxy fiberglass G10 ($\in_r$=4.4) and includes conductive microstrip feed lines 107; however, any suitable materials and/or configurations may be used. In the example embodiment, feed lines 107 disposed on or within dielectric layer 106 communicatively couple radiating elements 102 to respective coaxial connectors 108; however, various embodiments may not include coaxial connectors 108.

Thus, the example embodiment provides a shallow support structure antenna capable of both transmitting and receiving signals over a 10:1 bandwidth. In terms of $f_{max}$, the length 118 or shallow "depth" of each radiating element 102 is approximately two wavelengths with respect to $f_{max}$, or approximately one seventh of a wavelength with respect to a low frequency approximately 7.5% that of $f_{max}$. Details associated with the frequency response of antenna 100 are further explained with reference to the graphical representation of FIG. 2.

Figure 2:
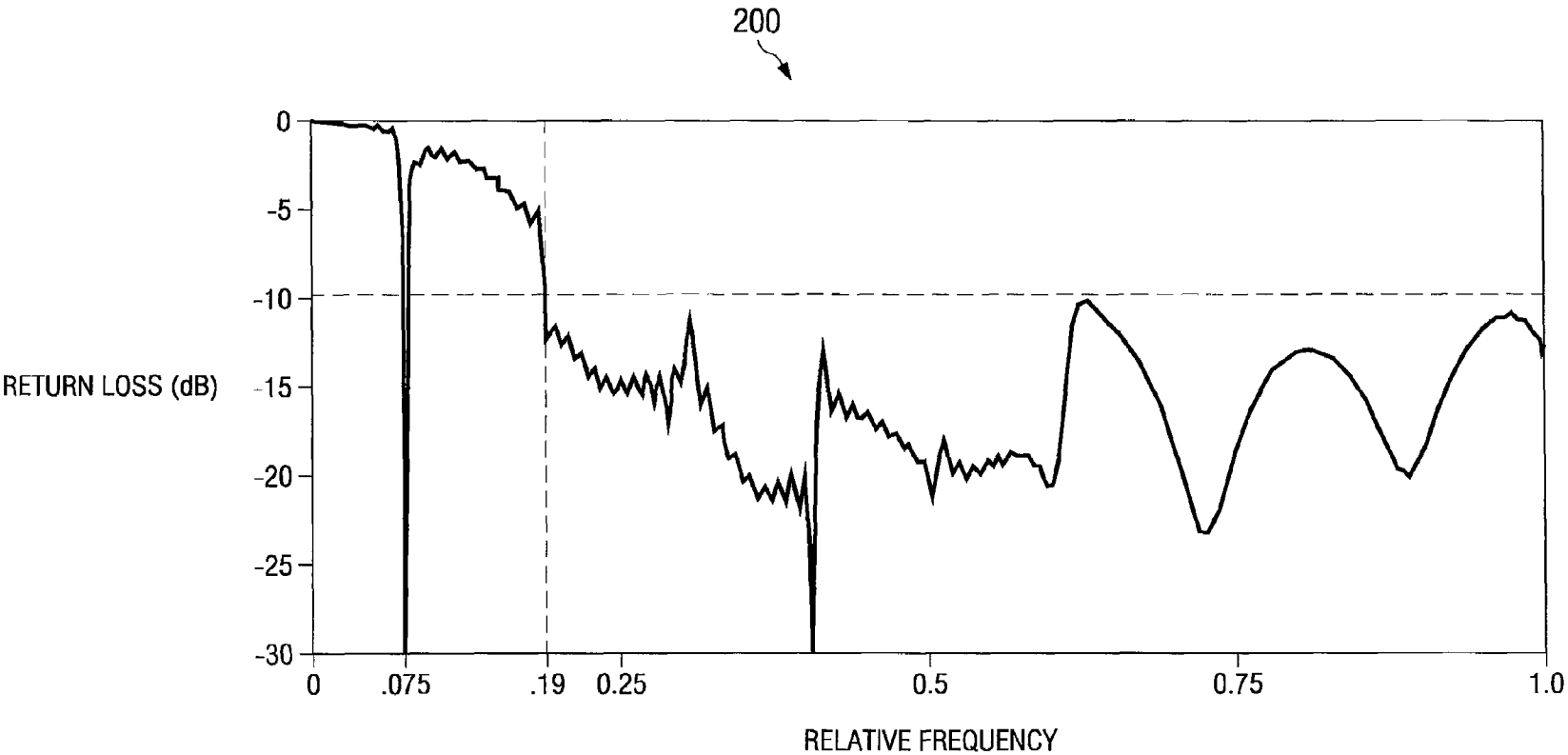
FIG. 2 is a graph showing return loss as a function of frequency for the antenna of FIG. 1.

FIG. 2 is a graph 200 showing return loss as a function of frequency for the antenna 100 of FIG. 1. Because return loss is a standard way of expressing reflection, it is often desirable that return loss be as low as possible. As shown in FIG. 2, antenna 100 provides a return loss bandwidth that is continuously below −10 db from 19% $f_{max}$ to 100% $f_{max}$. In addition, antenna 100 provides added spot coverage over a narrow band centered at approximately 7.5% $f_{max}$. Expressed according to another industry standard, antenna 100 provides a bandwidth of at least 5:1 for −10 dB, with added spot coverage below one tenth of $f_{max}$.

Various alternative embodiments may also provide shallow structure antennas capable of transmitting and/or receiving over a 10:1 bandwidth. Some such alternative example embodiments are illustrated in FIGS. 3 through 5.

FIG. 3 is an exploded view of a portion of an antenna 300 having plural stripline circuit cards 301 and 303 according to one alternative embodiment of the present disclosure. In operation, antenna 300 is capable of efficiently transmitting and receiving signals over a wide bandwidth in a manner substantially similar to antenna 100 of FIG. 1.

Stripline circuit card 301 generally includes a conductive portion 304 disposed within or outwardly from a dielectric portion 306. Conductive portion 304 may be formed from any conductive material operable to conduct a signal, such as, for example, copper. Dielectric portion 306 may be formed from any suitable dielectric, such as, for example, epoxy fiberglass. Forming conductive portion 302 may be effected by any of a variety of processes. For example, a metallized surface may be deposited on dielectric portion 306 and then selectively etched to form radiating elements 302. Although the example embodiment includes four radiating elements 302*a*, 302*b*, 302*c*, and 302*d*, any suitable number of radiating elements may be used.

Each radiation element 302 generally includes a balun 312, half-spade-shape portions 313, slots 314, dipole arms 315, and a notch 316, which are each substantially similar in function and top-down dimension to baluns 112, portions 113, slots 114, dipole arms 115, and notches 116 of FIG. 1 respectively. A set of plated vias 318 and 320 generally facilitate coupling together stripline circuit cards 301 and 303.

Stripline circuit card 303 generally includes stripline feed lines 321 disposed on or within a dielectric portion 322. Each feed line 321 couples a respective radiating element 302 to a respective coaxial connector 323; however, various embodiments may not include coaxial connectors 323. Dielectric portion 322 may be any suitable dielectric, such as, for example, epoxy fiberglass.

In the example embodiment, a set of slot capacitors 305 and a set of dipole capacitors 307 are substantially similar in structure, function, and configuration to slot capacitors 105 and dipole capacitors 103 of FIG. 1 respectively. Various alternative embodiments using plural stripline circuit cards 301 and 303 may not include discrete component capacitors 305 and 307. One example of such an alternative embodiment is illustrated in FIG. 4.

FIG. 4 is an exploded view of a portion of an antenna 400 that capactively couples the plural stripline circuit cards 301 and 303 of FIG. 3 to a cover sheet 402 according to one alternative embodiment of the present disclosure. Thus, a difference between the example embodiment of FIG. 4 and that of FIG. 3 is the use of cover sheet 402 in place of capacitor sets 305 and 307.

Cover sheet 402 includes plural conductive strips 404 and 406 disposed outwardly from or within a thin dielectric layer 408. Conductive strips 404 and 406 perform functions substantially similar to slot capacitors 305 and dipole capacitors 307 of FIG. 3 respectively. Conductive strips 404 and 406 may be formed from any suitable conductive material using any suitable processing technique. Dielectric layer 408 may be formed from any suitable dielectric. The capacitive coupling effected by capacitive cover sheet 402 is determined by capacitive cover sheet 402 thickness, permittivity, and the conductive overlap area of conductive strips 404 and 406 and the inwardly disposed conductive portions of circuit card 301.

Although the example embodiments of FIGS. 1 through 4 use microstrip or stripline feed lines to communicatively couple radiating elements to respective connectors, any of a variety of feed mechanisms may be used. An alternative example is illustrated in FIG. 5.

FIG. 5 illustrates a perspective view of a single radiating element 500 having a coaxial feed 502 according to one embodiment of the present disclosure. In the example embodiment, coaxial feed 502 enters through and is disposed within a channel 504 of a first conductive finger 506. Following channel 504, the coaxial feed 502 bridges a slot 514, continues beyond a dipole arm 515*a*, bridges notch 516, and couples to a second dipole arm 515*b* of a second conductive finger 508. Due in part to channel 504, dipole arm 515*a* in the illustrated example is asymmetric with respect to dipole arm 515*b*.

Thus, the present disclosure provides various cost-effective embodiments for physically shallow antennas operable to efficiently transmit and receive signals over a 10:1 bandwidth. Although the present disclosure has been described with several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An antenna comprising:

an array of radiating elements, each radiating element comprising:

a pair of conductive fingers each having first and second portions separated by a slot, the first portion being a dipole arm, the conductive fingers separated by a tapered notch having a width at a first end less than a width of a second end;

a balun proximate the first end; and wherein, for each conductive finger, the first portion of the conductive finger is capacitively coupled to the second portion of the conductive finger by one or more capacitive elements, each capacitive element selected from the group consisting of:

a capacitor;

a varactor diode; and conductive material disposed on a dielectric layer, the dielectric layer coupled to the array of radiating elements;

a support structure coupled to the array of radiating elements; and a plurality of signal conduits coupled to respective ones of the radiating elements.

2. The antenna of claim 1, wherein:

the antenna is operable to receive a plurality of signals each having a respective wavelength, the reception of each signal having a return loss value less than −10 dB, the plurality of signals comprising a minimum wavelength;

a maximum length of the radiating element is at most approximately two times the minimum wavelength; and a maximum width of the radiating element is at most approximately 0.58 times the minimum wavelength.

3. The antenna of claim 1, wherein the antenna is operable to receive and transmit a plurality of signals each having a frequency, the plurality of signals comprising a maximum frequency and a minimum frequency, the reception and transmission of each signal having a return loss less than −10 db; and wherein the minimum frequency is less than approximately one tenth the maximum frequency.

4. The antenna of claim 1, wherein dielectric material is disposed within the slot.

5. A method of forming a radiating element comprising:

forming a pair of conductive fingers each having first and second portions, the first portion being a dipole arm, the conductive fingers separated by a tapered notch having a width at a first end less than a width of a second end; and for each conductive finger, capacitively coupling the first portion of the conductive finger to the second portion of the conductive finger by one or more capacitive elements, each capacitive element selected from the group consisting of:

a capacitor;

a varactor diode; and conductive material disposed on a dielectric layer coupled to the first and second portions.

6. The method of claim 5 further comprising forming a slot within each conductive finger that separates the first portion from the second portion.

7. The method of claim 6, wherein the slot has a profile approximately parallel to a tapered profile of the tapered notch.

8. The method of claim 6, wherein the slot has a sufficiently narrow width to capacitively couple the first portion of the conductive finger to the second portion of the conductive finger.

9. The method of claim 5, wherein forming a pair of conductive fingers having first and second portions comprises machining a solid, conductive plate.

10. The method of claim 5, wherein forming a pair of conductive fingers having first and second portions comprises selectively removing portions of a conductive layer using a photolithographic technique.

11. The method of claim 5 further comprising:

receiving a plurality of signals each having a respective wavelength, the reception of each signal having a return loss value less than −10 dB, the plurality of signals comprising a minimum wavelength;

wherein a maximum length of the radiating element is at most approximately two times the minimum wavelength; and wherein a maximum width of the radiating element is at most approximately 0.58 times the minimum wavelength.

12. The method of claim 5 further comprising:

receiving and transmitting a plurality of signals each having a frequency, the plurality of signals comprising a maximum frequency and a minimum frequency, the transmission and reception of each signal having a return loss less than −10 db; and wherein the minimum frequency is less than approximately one tenth the maximum frequency.

13. The method of claim 5, further comprising controlling a frequency resonance of the pair of conductive fingers at least in part using the one or more capacitive elements.

14. The method of claim 13, wherein the controlled frequency resonance is less than approximately one tenth of a maximum frequency resonance of the pair of conductive fingers.

15. The method of claim 5, wherein the slot has a profile approximately coplanar with a tapered profile of the tapered notch.

16. The method of claim 5, wherein each capacitive element is disposed outwardly from the first and second portions of the conductive finger.

17. A radiating element comprising:

a pair of conductive fingers having first and second portions, the first portion being a dipole arm, the conductive fingers separated by a tapered notch having a width at a first end less than a width of a second end;

a balun proximate the first end; and wherein, for each conductive finger, the first portion of the conductive finger is capacitively coupled to the second portion of the conductive finger by one or more capacitive elements, each capacitive element selected from the group consisting of:

a capacitor;

a varactor diode; and conductive material disposed on a dielectric layer coupled to the first and second portions.

18. The radiating element of claim 17, wherein the first portion of the conductive finger and the second portion of the conductive finger are separated by a slot.

19. The radiating element of claim 18, wherein the slot has a profile approximately parallel to a tapered profile of the tapered notch.

20. The radiating element of claim 18, wherein the slot has a sufficiently narrow width to capacitively couple the first portion of the conductive finger to the second portion of the conductive finger.

21. The radiating element of claim 17, wherein the one or more capacitive elements are disposed outwardly from the first and second portions of the conductive finger.

22. The radiating element of claim 17, wherein:

the radiating element is operable to receive a plurality of signals each having a respective wavelength, the reception of each signal having a return loss value less than −10 dB, the plurality of signals comprising a minimum wavelength;

a maximum length of the radiating element is at most approximately two times the minimum wavelength; and a maximum width of the radiating element is at most approximately 0.58 times the minimum wavelength.

23. The radiating element of claim 17, wherein:

the radiating element is operable to receive and transmit a plurality of signals each having a frequency, the plurality of signals comprising a maximum frequency and a minimum frequency, the reception and transmission of each signal having a return loss less than −10 db; and wherein the minimum frequency is less than approximately one tenth the maximum frequency.

* * * * *